US012624872B2

(12) United States Patent
Rossi

(10) Patent No.: US 12,624,872 B2
(45) Date of Patent: May 12, 2026

(54) HEAT PUMP SYSTEM AND COMPONENTS THEREOF

(71) Applicant: Terravis Energy, Inc., West Seneca, NY (US)

(72) Inventor: Lorenzo H. Rossi, Richmond Hill (CA)

(73) Assignee: Terravis Energy, Inc., West Seneca, NY (US)

( * ) Notice: Subject to any disclaimer, the term of this patent is extended or adjusted under 35 U.S.C. 154(b) by 0 days.

(21) Appl. No.: 19/282,525

(22) Filed: Jul. 28, 2025

(65) Prior Publication Data

US 2026/0098669 A1 Apr. 9, 2026

Related U.S. Application Data

(60) Provisional application No. 63/704,764, filed on Oct. 8, 2024.

(51) Int. Cl.
*F25B 41/40* (2021.01)

(52) U.S. Cl.
CPC ..... *F25B 41/40* (2021.01)

(58) Field of Classification Search
CPC ..... F25B 41/40
See application file for complete search history.

(56) References Cited

U.S. PATENT DOCUMENTS 2,467,177 A 4/1949 Zimmer
5,081,846 A * 1/1992 Dudley ..... F24H 15/258 62/238.7
11,592,215 B2 * 2/2023 Brown ..... F25B 41/35
2011/0238362 A1 9/2011 Kidwell
2022/0412575 A1 * 12/2022 Huang ..... F24F 3/065

FOREIGN PATENT DOCUMENTS

KR 20100071826 A 6/2010
KR 20110083261 A * 7/2011

OTHER PUBLICATIONS

International Search Report and the Written Opinion of the International Searching Authority, PCT Application No. PCT/US2025/039480, dated Oct. 8, 2025, pp. 1-10.

* cited by examiner

*Primary Examiner* — Ana M Vazquez
(74) *Attorney, Agent, or Firm* — Bond, Schoeneck & King, PLLC

(57) ABSTRACT

A heat pump system is provided. The heat pump system includes a refrigerant circuit through which a refrigerant is caused to flow and an antifreeze circuit through which an antifreeze solution is caused to flow having an antifreeze accumulator tank. The refrigerant circuit includes a first refrigerant coil arranged within a first heat exchanger and a second refrigerant coil arranged within a second heat exchanger. The antifreeze accumulator tank heats an antifreeze solution. The antifreeze circuit includes an antifreeze coil arranged within the first heat exchanger and proximate to the first refrigerant coil such that the antifreeze coil heats the first refrigerant coil. In some examples, the antifreeze accumulator tank includes a controllable heater arranged to heat the antifreeze solution. In other examples, the refrigerant circuit further includes a third refrigerant coil arranged within the antifreeze accumulator tank such that the third refrigerant coil heats the antifreeze solution.

19 Claims, 9 Drawing Sheets

HEAT PUMP SYSTEM AND COMPONENTS THEREOF

CROSS-REFERENCE TO RELATED APPLICATIONS

This application claims priority to U.S. Provisional Patent Application Ser. No. 63/704,764, entitled "Heat Pump System and Components Thereof," filed on Oct. 8, 2024, which application is hereby incorporated by reference in its entirety.

FIELD OF THE DISCLOSURE

This disclosure relates, generally, to heat pumps, and more specifically, to a heat pump system having an antifreeze mechanism to prevent frost from forming on an outdoor heat exchanger.

BACKGROUND

Heat pumps are energy-efficient alternatives to furnaces and air conditioners. Air-source heat pumps provide heat to an interior of a building by pulling heat from outdoor air and transferring it indoors. Accordingly, heat pumps require both an outdoor heat exchanger and an indoor heat exchanger to facilitate this transfer. One disadvantage to conventional air-source heat pumps is that in cold outdoor conditions, frost can form on the outdoor unit. This frost can prevent the heat pump from efficiently pulling heat from the outdoor air. Thus, currently available heat pumps are configured to enter a defrost cycle when frost has formed on the outdoor unit. While the defrost cycle may reduce the amount of frost, these heat pumps stop producing heat during the defrost cycle. Further, the defrost cycle reduces the energy efficiency of the heat pump by diverting energy for purposes other than heating the interior of the building.

The present disclosure advantageously addresses one or more of the problems and deficiencies of the heat pumps discussed above. However, it is contemplated that the subject matter of the disclosure may prove useful in addressing other problems and deficiencies in a number of technical areas. Therefore, the present disclosure should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

SUMMARY OF THE DISCLOSURE

The present disclosure is generally directed to a heat pump system for use in cold weather environments. Broadly, the heat pump system includes a dual circuit configuration (which may also be referred to as a dual path configuration) to prevent frost formation at very low temperatures, thereby avoiding the need to run inefficient defrost cycles when heating is required. The heat pump system includes a refrigerant circuit (which may also be referred to as a refrigerant path), an antifreeze circuit (which may also be referred to as an antifreeze path) having an antifreeze accumulator tank, an outdoor heat exchanger, and an indoor heat exchanger. The refrigerant circuit is configured to circulate refrigerant (e.g., R32, R454B, or R452B refrigerants) to different aspects of the heat pump system. The refrigerant circuit includes a first refrigerant coil arranged within the outdoor heat exchanger, and a second refrigerant coil arranged within the indoor heat exchanger. Similarly, the antifreeze circuit is configured to circulate an antifreeze solution. The antifreeze solution is heated as it is stored and cycled through the antifreeze accumulator tank. The antifreeze circuit includes an antifreeze coil arranged within the outdoor heat exchanger. The antifreeze coil is arranged proximate to the first refrigerant coil, such that the antifreeze coil heats the first refrigerant coil to prevent the formation of frost. This arrangement may prevent the formation of frost at outdoor temperatures of −5° F. and lower, preferably −10° F. and lower, down to about −30° F. or even down to about −50° F.

In one embodiment, a controllable heater, such as an electric rod is arranged within the antifreeze tank to heat the antifreeze solution. Further, a temperature sensor is also arranged within the antifreeze tank. A temperature signal provided by the temperature sensor is used to regulate the temperature of the controllable heater. The temperature of the controllable heater may vary from 180° F. to 200° F., for example. In further examples, the controllable heater may be deactivated at certain ambient outdoor temperatures when the heater is a heat pump system functioning in a cooling mode, rather than heating mode, resulting in unheated, ambient temperature antifreeze solution. Circulating the ambient temperature antifreeze solution allows the antifreeze coil to function as a heat sink to regulate the temperature of the first refrigerant coil, preventing the formation of hot spots on the first refrigerant coil at high ambient outdoor temperatures.

In alternate embodiments, a third refrigerant coil is arranged within the antifreeze accumulator tank to passively heat the antifreeze solution via the refrigerant circuit. The antifreeze solution may be circulated through the antifreeze circuit by an antifreeze pump with a pump speed of at least 5.2 gallons per minute, for example.

The antifreeze solution includes an antifreeze additive. The antifreeze solution may be a mixture of the antifreeze additive and water, though any suitable antifreeze solution is contemplated herein. In some examples, the ratio of antifreeze additive to water is 50:50. The antifreeze additive may preferably silicone oil. In other examples the antifreeze additive could be ethylene glycol or another suitable antifreeze additive. Preferably, the antifreeze solution has a freezing point of less than or equal to approximately −30° F. and a boiling point of greater than or equal to approximately 250° F. The refrigerant may be R32 refrigerant, R454B refrigerant, R452B refrigerant, or a combination thereof. The boiling point of the refrigerant may be less than or equal to approximately −50° F.

The outdoor heat exchanger may include several layers, such as an external layer facing the outdoor environment and one or more internal layers. In some examples, the antifreeze coil is arranged within the external layers, while the first refrigerant coil is arranged within the one or more internal layers.

Generally, in one aspect, a heat pump system is provided. The heat pump system includes a refrigerant circuit through which a refrigerant is caused to flow. The refrigerant circuit includes a first refrigerant coil arranged within a first heat exchanger. The refrigerant circuit further includes a second refrigerant coil arranged within a second heat exchanger.

The heat pump system further includes an antifreeze circuit through which an antifreeze solution is caused to flow. The antifreeze circuit includes an antifreeze accumulator tank configured to heat the antifreeze solution.

The antifreeze circuit further includes an antifreeze coil arranged within the first heat exchanger and proximate to the first refrigerant coil such that the antifreeze coil regulates a temperature of the first refrigerant coil.

The heat pump system is configured to operate continuously without entering a defrost cycle, without compressor stall, and/or without refrigerant lock-up at an outdoor ambient temperature below about −5° F.

According to an example, the antifreeze accumulator tank comprises a controllable heater arranged to heat the antifreeze solution.

According to an example, the antifreeze accumulator tank further includes a temperature sensor configured to generate a temperature signal. A temperature of the controllable heater is controlled based on the temperature signal.

According to an example, the temperature of the controllable heater ranges from 180° F. to 200° F.

According to an example, an ambient temperature sensor configured to capture the outdoor ambient temperature, wherein the controllable heater is deactivated if the outdoor ambient temperature is greater than about 68° F.

According to an example, the refrigerant circuit further comprises a third refrigerant coil arranged within the antifreeze accumulator tank such that the third refrigerant coil heats the antifreeze solution.

According to an example, a freezing point of the antifreeze solution is less than or equal to about −30° F.

According to an example, a boiling point of the antifreeze solution is greater than or equal to about 200° F.

According to an example, the antifreeze solution includes silicone oil.

According to an example, the heat pump system is configured to operate continuously without entering a defrost cycle, without compressor stall, and/or without refrigerant lock-up at the outdoor ambient temperature as low as about −56.9° F.

According to an example, the heat pump system comprises a cooling mode, in which the antifreeze coil is configured to be a heat sink that prevents hot spot formation on the first refrigerant coil up to an ambient temperature of about 86° F.

According to an example, the first heat exchanger is configured to be arranged in an outdoor environment. The second heat exchanger is configured to be arranged in an indoor environment.

According to an example, the heat pump system further includes an antifreeze fluid pump. The antifreeze fluid pump is configured to propel the antifreeze solution through the antifreeze circuit. The antifreeze fluid pump has a pump speed of at least 5.2 gallons per minute.

According to an example, the heat pump system further includes a controllable heater arranged to heat the antifreeze solution. The heat pump system further includes a controller configured to receive an ambient temperature and the temperature of the first refrigerant coil and to modulate the controllable heater and the antifreeze fluid pump.

According to an example, the first heat exchanger comprises an external coil layer and at least one internal coil layer. The antifreeze coil is arranged within the external coil layer. The first refrigerant coil is arranged within the at least one internal coil layer.

Generally, in another aspect, a heat exchanger is provided. The heat exchanger is configured to be installed in a heat pump system. The heat exchanger includes a refrigerant circuit through which a refrigerant is caused to flow. The refrigerant circuit comprises a refrigerant coil.

The heat exchanger further includes an antifreeze circuit through which an antifreeze solution is caused to flow.

The antifreeze circuit includes an antifreeze accumulator tank configured to heat the antifreeze solution.

The antifreeze circuit further includes an antifreeze coil arranged proximate to the refrigerant coil such that the antifreeze coil regulates a temperature of the refrigerant coil.

Generally, in another aspect, a heat pump system is provided. The heat pump system includes a refrigerant circuit through which a refrigerant is caused to flow. The refrigerant circuit includes a refrigerant coil arranged within an outdoor heat exchanger.

The heat pump system further includes an antifreeze circuit through which an antifreeze solution is caused to flow. The antifreeze circuit includes an antifreeze coil arranged within the outdoor heat exchanger and proximate to the refrigerant coil to (i) prevent frost formation on the refrigerant coil in ambient outdoor temperatures lower than about −5° F. and (ii) prevent hot spot formation in ambient outdoor temperatures from about 68° F. to about 86° F.

According to an example, a freezing point of the antifreeze solution is less than or equal to about −30° F. It is noted that certain solutions of ethylene glycol (e.g., 50/50 ethylene glycol and water) can have a freezing point of about −30° F. A higher concentration of ethylene glycol in solution would increase the freezing point. It is further noted that certain silicone oils can have a freezing point of about −50° F. down to about −100° F. or lower, depending on the composition of the oil. All suitable options are contemplated herein.

According to an example, a boiling point of the antifreeze solution is greater than or equal to about 200° F. It is noted that certain solutions of ethylene glycol (e.g., 50/50 ethylene glycol and water) can have a boiling point of about 225° F. A higher concentration of ethylene glycol in solution would decrease the boiling point. It is further noted that certain silicone oils can have a boiling point of about 284° F. up to about 536° F. or higher, depending on the composition of the oil. All suitable options are contemplated herein.

According to an example, a boiling point of the refrigerant is less than or equal to about −50° F. It is noted that R32 refrigerant has a boiling point of about −61° F., R454B refrigerant has a boiling point of about −59° F., and R452B refrigerant has a boiling point of about −60° F. All suitable options are contemplated herein.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

These and other aspects of the various embodiments will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various embodiments.

DETAILED DESCRIPTION OF EMBODIMENTS

In the following detailed description of the preferred embodiments, reference is made to the accompanying drawings, which form a part thereof, and within which are shown by way of illustration specific embodiments by which the subject matter of the disclosure may be practiced. It is to be understood that other embodiments may be utilized and structural changes may be made without departing from the scope of the disclosure.

The present disclosure is generally directed to a heat pump system, or a component thereof, for use in cold weather environments. Broadly, the heat pump system includes a dual coil configuration to prevent frost formation at very low temperatures, thereby avoiding the need to run inefficient defrost cycles when heating is required. The heat pump system includes a refrigerant circuit, an antifreeze circuit having an antifreeze accumulator tank, an outdoor heat exchanger, and an indoor heat exchanger. The refrigerant circuit is configured to convey refrigerant to different aspects of the heat pump system. The refrigerant circuit includes a first refrigerant coil arranged within the outdoor heat exchanger, and a second refrigerant coil arranged within the indoor heat exchanger. Similarly, the antifreeze circuit is configured to convey an antifreeze solution. The antifreeze solution is heated as it is stored and cycled through the antifreeze accumulator tank. The antifreeze circuit includes an antifreeze coil arranged within the outdoor heat exchanger. The antifreeze coil is arranged proximate to the first refrigerant coil, such that the antifreeze coil heats the first refrigerant coil to prevent the formation of frost. In further examples, ambient temperature (rather than heated) antifreeze solution may be circulated to prevent the formation of hot spots on the first refrigerant coil when the heat pump system operates in a cooling mode at high ambient outdoor temperatures.

Figure 1:
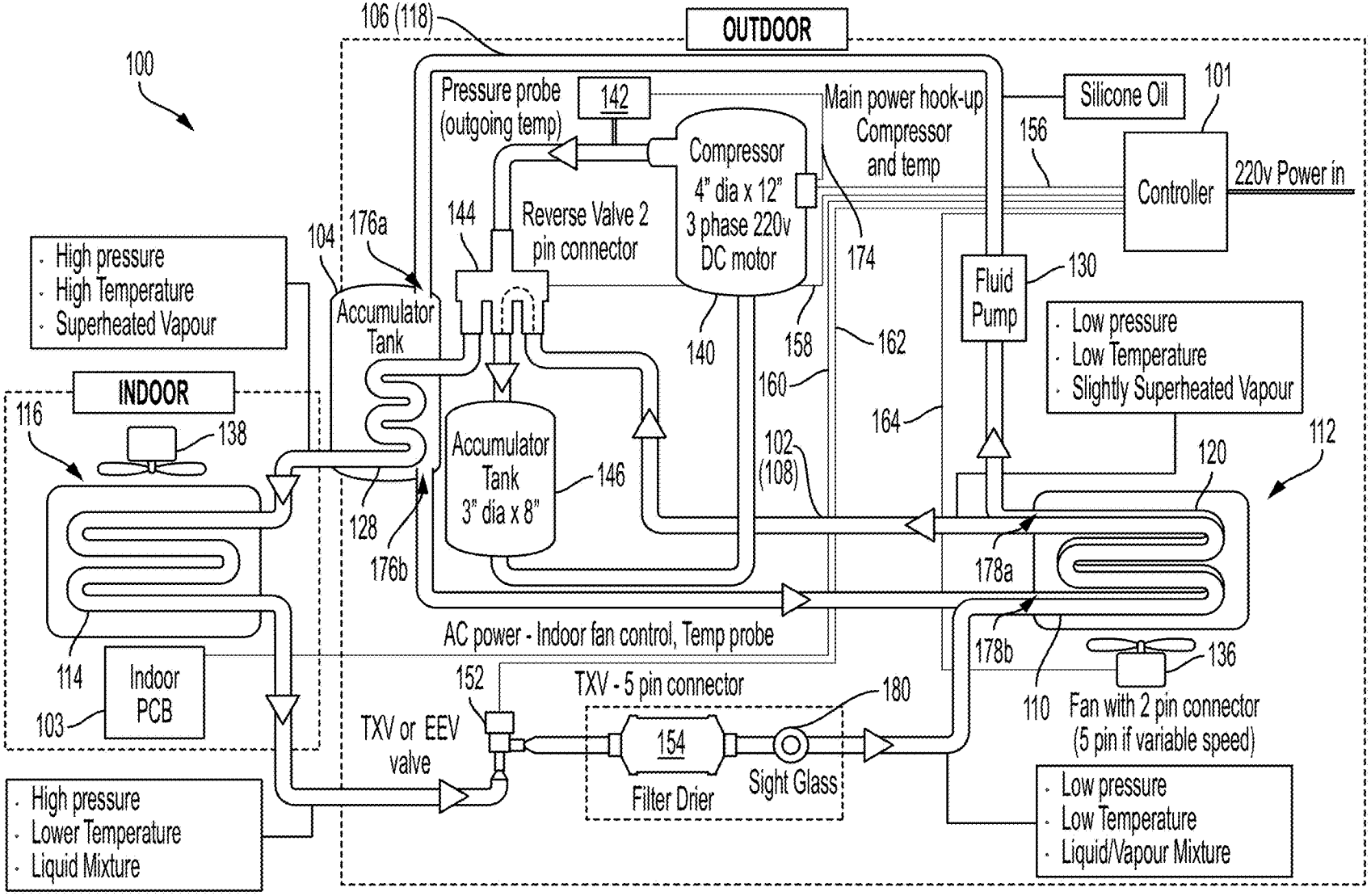
FIG. 1 is a flow diagram of a heat pump system, according to aspects of the present disclosure.

Turning now to the figures, FIG. 1 is a flow diagram of a non-limiting example of an air-source heat pump system 100. While the example of FIG. 1 shows the heat pump system 100 configured to heat an indoor area, the same heat pump system 100 could also be configured to cool the same indoor area. Broadly, the heat pump system 100 includes a refrigerant circuit 102 (which may also be referred to as a refrigerant path) and an antifreeze circuit 106 (which may also be referred to as an antifreeze path). Each of the circuits 102, 106 (or paths) are made of several pipes (which may also be referred to as refrigerant pipes or antifreeze pipes) connecting various components of the heat pump system 100. The refrigerant circuit 102 is configured to circulate or convey a refrigerant 108 throughout the heat pump system 100. Similarly, the antifreeze circuit 106 is configured to circulate or convey an antifreeze solution 118 throughout the heat pump system 100. The pipes may be made of any appropriate material or combination of materials appropriate for conveying the refrigerant 108 (for the refrigerant circuit 102) or the antifreeze solution 118 (for the antifreeze circuit 106). Each of the pipes may be flexible or inflexible depending on the requirements of the heat pump system 100.

The example heat pump system 100 of FIG. 1 includes an outdoor controller 101, an indoor controller 103, an antifreeze accumulator tank 104, an outdoor heat exchanger 112, an indoor heat exchanger 116, a fluid pump 130, an outdoor fan 136, an indoor fan 138, a compressor 140, a pressure probe 142, a reverse valve 144, a refrigerant accumulator tank 146, an expansion valve 152, a filter drier 154, and a sight glass 180. Not all of the foregoing components may be required by the heat pump system 100, but all are shown for illustrative purposes. The indoor controller 103, the indoor heat exchanger 116, and the indoor fan 138 are configured to be arranged in an indoor environment, such as within a residential home or commercial building. The outdoor controller 101, the antifreeze accumulator tank 104, the outdoor heat exchanger 112, the fluid pump 130, the outdoor fan 136, the compressor 140, the pressure probe 142, the reverse valve 144, the refrigerant accumulator tank 146, the expansion valve 152, the filter drier 154, and the sight glass 180 are configured to be arranged in an outdoor environment near the indoor environment, such as just outside of the residential home or commercial building.

In the non-limiting example of FIG. 1, the refrigerant circuit 102 includes a first refrigerant coil 110, a second refrigerant coil 114, a third refrigerant coil 128, the compressor 140, the reverse valve 144, the refrigerant accumulator tank 146, the expansion valve 152, the filter drier 154, the sight glass 180, and a plurality of pipes or pathways connecting the aforementioned components, of which certain components may be eliminated but still contemplated within the scope of the current invention. The antifreeze circuit 106 includes the antifreeze accumulator tank 104, an antifreeze coil 120, the fluid pump 130, and a plurality of pipes or pathways connecting the aforementioned components. The refrigerant circuit 102 circulates the refrigerant 108 throughout the outdoor and indoor environments, while the antifreeze circuit 106 circulates the antifreeze solution 118 only within the outdoor environment. As can be seen in FIG. 1, the first refrigerant coil 110 and the antifreeze coil 120 are arranged within the outdoor heat exchanger 112, while the second refrigerant coil 114 is arranged within the indoor heat exchanger 116. In this arrangement, the outdoor fan 136 blows outdoor air through the first refrigerant coil 110 to pull heat out of the outdoor environment. The outdoor controller 101 may control the outdoor fan 136 based on an outdoor control signal 164. The co-located antifreeze coil 120 heats the first refrigerant coil 110 to prevent frost from forming on the first refrigerant coil 110, thereby preventing the triggering of a wasteful and energy inefficient defrost cycle.

As shown in FIG. 1, the compressor 140 receives refrigerant 108 from the refrigerant accumulator tank 146 and converts the refrigerant 108 into a high pressure, high temperature, superheated vapor. In some examples, the refrigerant 108 may be R32 refrigerant (boiling point about −61° F.), R454B refrigerant (boiling point about −59° F.), or R452B refrigerant (boiling point about −60° F.), or a combination thereof. Generally, the refrigerant preferably has a boiling point of about −50° F. or lower. The non-limiting example of the refrigerant accumulator tank 146 is a cylindrical tank eight inches in height and three inches in diameter, though other dimensions may be used in different applications. The non-limiting example of the compressor 140 is a cylindrical tank twelve inches in height and four inches in diameter, though other dimensions may be used in different applications. The compressor 140 includes a three phase, 220-volt direct current (DC) motor. The motor of the compressor 140 produces a flow of heated refrigerant 108 according to a motor control signal 156 received from the outdoor controller 101 as well as a pressure feedback signal 174 received from the pressure probe 142.

The refrigerant circuit 102 (also referred to as the refrigerant path) conveys the heated refrigerant 108 from the compressor 140 to the second refrigerant coil 114 arranged inside the indoor heat exchanger 116. The indoor fan 138 pushes air through the second refrigerant coil 114 to heat the indoor area. The indoor fan 138 may be controlled by the indoor controller 103. The indoor controller 103 may control the indoor fan 138 based on an indoor control signal 160 provided by the outdoor controller 101. The indoor controller 103 may also provide feedback (such as indoor temperature measurements) to the outdoor controller 101 used to control other aspects of the heat pump system 100.

After passing through the second refrigerant coil 114, the refrigerant 108 exits the indoor heat exchanger 116 as a high pressure, lower temperature (relative to the refrigerant 108 entering the indoor heat exchanger 116), liquid mixture. Thus, the second refrigerant coil 114 functions as a condenser which condenses the superheated vapor to a warm liquid. The refrigerant 108 passes through an expansion valve 152 and significantly reduces temperature. The expansion valve 152 may be a thermal expansion valve (TXV) or an electronic expansion valve (EEV). In the case of an EEV, the expansion valve 152 controls the flow of the refrigerant 108 according to an expansion control signal 162 provided by the outdoor controller 101. The refrigerant 108 then passes through the filter drier 154 which removes contaminants, such as moisture, from the refrigerant 108. The refrigerant 108 then passes through the sight glass 180 which enables observation of the refrigerant 108 for quality control purposes. After passing through the sight glass 180, the refrigerant 108 is a low pressure, low temperature, liquid/vapor mixture.

The refrigerant 108 is then provided to the first refrigerant coil 110. In this configuration, the first refrigerant coil 110 acts an as evaporator such that the refrigerant 108 absorbs outdoor heat, even in cold conditions. Accordingly, the refrigerant 108 exits the first refrigerant coil 110 as a low pressure, low temperature, slightly superheated vapor. The refrigerant circuit 102 then directs the refrigerant 108 to the refrigerant accumulator tank 146 via the reverse valve 144. The reverse valve 144 is controlled via reverse signal 158 provided by the outdoor controller 101. The refrigerant 108 then flows from the refrigerant accumulator tank 146 to the compressor 140, and the heating cycle begins again.

As previously mentioned, the antifreeze circuit 106 (also referred to as the antifreeze path) circulates the antifreeze solution 118 throughout the heat pump system 100 to prevent frost from forming on the first refrigerant coil 110 arranged in the outdoor environment. The antifreeze solution comprises an antifreeze additive and, in some examples, the antifreeze additive is mixed with water. In a preferred example, the antifreeze solution 118 is silicone oil, with silicone oil having a freezing point of about −112° F. and a boiling point of about 536° F. In other examples, the antifreeze solution 118 may be a 50/50 mixture of ethylene glycol (as antifreeze additive) and water, resulting in a solution or mixture having a freezing point of about −34° F. and a boiling point of about 265° F. As can be seen, silicone oil is preferred due to having a broader thermal capacity than ethylene glycol, but both (along with other suitable solutions) are contemplated by the current invention depending on needs or requirements. Generally, the antifreeze solution 118 preferably has a freezing point of about −30° F. or lower (e.g., −34° F. for 50/50 ethylene glycol/water, −58° F. for silicone oil) and/or a boiling point of about 200° F. (e.g., 225° F. for 50/50 ethylene glycol/water, 572° F. for silicone oil). Freezing and boiling points outside of these thresholds are contemplated as well, as significantly lower freezing points or significantly higher boiling points should not negatively impact the function of the heat pump system 100. Silicone oil also has the additional advantages of being food grade oil that is more environmentally friendly than ethylene glycol.

The antifreeze solution 118 is propelled through the antifreeze circuit 106 via a fluid pump 130. The fluid pump 130 may have a pump speed of at least about 5.2 gallons per minute. The antifreeze solution 118 is received by an upper port **176*a* of the antifreeze accumulator tank 104, which may be formed from rust-proof material such as aluminum or stainless steel. As shown in the non-limiting example of FIG. 1, a third refrigerant coil 128 of the refrigerant circuit 102 is arranged within the antifreeze accumulator tank 104. The refrigerant 108 within the third refrigerant coil 128 is a high pressure, high temperature, superheated vapor. Thus, the hot refrigerant 108 heats the antifreeze solution 118 within the antifreeze accumulator tank 104. The heated antifreeze solution 118 then exits the antifreeze accumulator tank 104 via a lower port 176*b* and is conveyed to antifreeze coil 120 also arranged within the outdoor heat exchanger 112. The first refrigerant coil 110 and the antifreeze coil 120 are physically co-located within the outdoor heat exchanger 112 in a dual-coil configuration such the heat from the antifreeze coil 120 prevents frost from forming on the first refrigerant coil. However, the flows of the refrigerant circuit 102 and the antifreeze circuit 106 remain separate and distinct. The antifreeze solution 118 then exits the antifreeze coil 120 and is recirculated by the fluid pump 130**.

Figure 2:
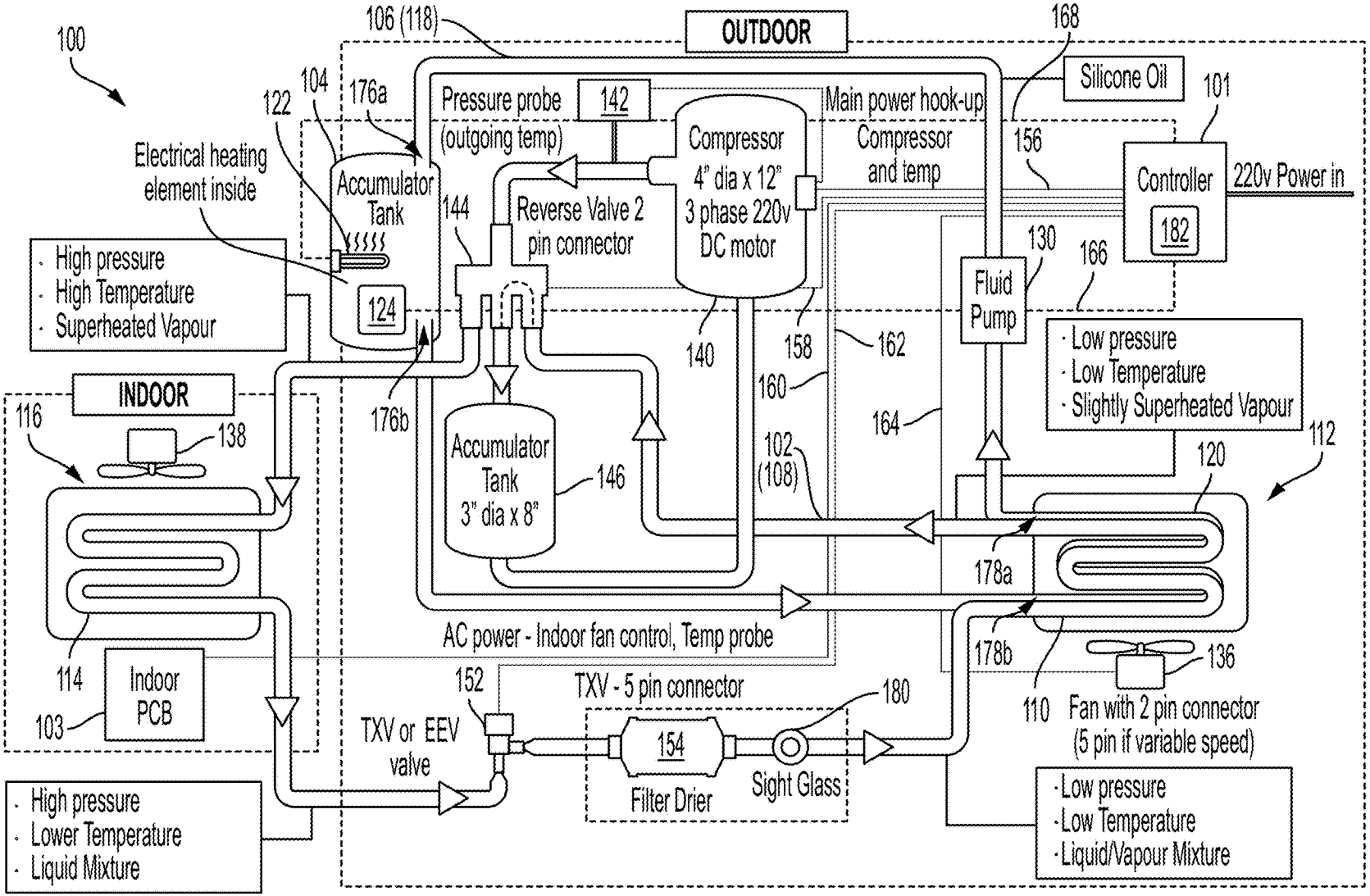
FIG. 2 is a flow diagram of a further heat pump system, according to aspects of the present disclosure.

FIG. 2 illustrates a variation of the heat pump system 100 of FIG. 1. In the non-limiting example of FIG. 2, the refrigerant circuit 102 (also referred to as the refrigerant path) lacks the third refrigerant coil 128 to heat the antifreeze solution 118 within the antifreeze accumulator tank 104. Instead, the antifreeze accumulator tank 104 includes a controllable heater 122 to heat the antifreeze solution 118. The controllable heater 122 may be a resistive heating element, such as an electrical rod. The temperature of the controllable heater 122 may range from about 180° F. to about 200° F. and may be controlled by a heater signal 168 provided by the outdoor controller 101. Further, a temperature sensor 124 may be provided within the antifreeze accumulator tank 104 to regulate the temperature of the controllable heater 122. In this example, the temperature sensor 124 provides a temperature signal 166 to the outdoor controller 101. Based on the temperature signal 166, the outdoor controller 101 may adjust the heater signal 168 to ensure proper temperature levels are provided by the controllable heater 122. Accordingly, this embodiment provides the advantage of being controllable and allowing the refrigerant 108 to maintain its heat, while the embodiment of FIG. 1 solely relies on the passive heat provided by the third refrigerant coil 128 and forces the refrigerant 108 to potentially lose heat to the antifreeze solution 118.

In some examples, the heat pump system 100 of FIG. 1 may be configured to operate in a cooling mode. The aforementioned examples are focused on operating the heat pump system 100 to heat the indoor environment while also preventing the formation of frost on the first refrigerant coil 110 in cold outdoor ambient temperatures. Frost prevention is achieved by conveying heated antifreeze solution 118 through the antifreeze coil 120 co-located with the first refrigerant coil 110.

However, in warm outdoor ambient temperatures, the heat pump system 100 of FIG. 1 is further configured to cool the indoor environment alternatively or in addition. In a conventional systems, a significant disadvantage is that the outdoor refrigerant coil can develop localized hot spots within the coil, leading to reduced heat dissipation, higher energy input, and increased workload for the compressor. Utilizing embodiments of the current invention, these hot spots can be prevented by circulating ambient temperature antifreeze solution 118 through the antifreeze coil 120 co-located with the first refrigerant coil 110. Accordingly, the antifreeze solution 118 causes the antifreeze coil 120 to act as a heat sink for the first refrigerant coil 110, stabilizing the overall temperature of the first refrigerant coil 110 and preventing the formation of hot spots. This temperature stabilization is particularly effective at moderately high ambient temperatures, such as from about 20° C. (68° F.) to about 30° C. (86° F.). Therefore, in some examples, the outdoor controller 101 may include or be connected to an ambient temperature sensor 182. If the ambient temperature sensor 182 detects an ambient temperature above 20° C., the outdoor controller 101 may use the heater signal 168 to deactivate the controllable heater 122 while continuing to circulate the antifreeze solution 118, resulting in the antifreeze solution 118 circulating at an ambient temperature. In further examples, the controller 101 may use the heater signal 168 to adjust or modulate the temperature of the controllable heater 122 according to the ambient temperature, rather than simply deactivating the controllable heater 122. In further examples, the outdoor controller 101 may also be connected to a coil temperature sensor configured to monitor the temperature of the first refrigerant coil 110, such that the heater signal 168 deactivates the controllable heater 122 if the coil temperature breaches a temperature threshold. Thus, in addition to preventing frost formation, the antifreeze coil 120 may more generally regulate the temperature of the first refrigerant coil 110 to prevent the formation of hot spots.

In this cooling example, the antifreeze solution 118 is preferably silicone oil due to its heat capacity. The heat capacity of silicone oil allows it to effectively absorb and transfer heat away from the first refrigerant coil 110. Further, even under continuous operation and circulation, silicone oil will retain its viscosity, allowing for consistent flow and temperature regulation.

Using the antifreeze coil 120 to cool the first refrigerant coil 110 provides a number of operational advantages. First, this configuration provides increased heat dissipation for the first refrigerant coil 110 and prevents localized overheating. Second, this improved heat dissipation may improve cooling capacity by up to 25%. During cooling, the first (outdoor) refrigerant coil 110 must effectively release heat absorbed by the second (indoor) refrigerant coil 114. Overheating the first refrigerant coil 110 reduces the temperature gradient between the first refrigerant coil 110 and the outdoor air, diminishing cooling capacity. Third, this improved heat dissipation may reduce overall power consumption by the heat pump system 100 by up to 15%. Fourth, simulations have shown that the system implementing this heat dissipation may have an estimated seasonal energy efficiency ratio (SEER) of 17.56, outperforming standing medium efficiency units (such as SEER 15 units) by 17.08%.

The non-limiting examples of FIGS. 1 and 2 illustrate the antifreeze solution 118 flowing in a counterclockwise manner from a first port 178*a* of the antifreeze coil 120, through the fluid pump 130, through the antifreeze accumulator tank 104, and then to a second port 178*b* of the antifreeze coil 120. However, in other examples, the antifreeze solution 118 may instead flow in a clockwise manner opposite to the flow illustrated in FIGS. 1 and 2. In these examples, the antifreeze solution 118 flows from the second port 178*b* of the antifreeze coil 120, through the antifreeze accumulator tank 104, through the fluid pump 130, and then to the first port 178*a* of the antifreeze coil 120. In the examples of the clockwise flow, the antifreeze accumulator tank 104 is reconfigured such that the second port 178*b* of the antifreeze coil 120 is connected to the upper port 176*a* of the antifreeze accumulator tank 104, and the fluid pump 130 is connected to the lower port 176*b* of the antifreeze accumulator tank 104.

Further, the non-limiting examples of FIGS. 1 and 2 illustrate the fluid pump 130 as connected between the first port 178*a* of the antifreeze coil 120 and the upper port 176*a* of the antifreeze accumulator tank 104. However, in other examples, the fluid pump 130 may be repositioned to connect the lower port 176*b* of the antifreeze accumulator tank 104 to the second port 178*b* of the antifreeze coil 120. In either arrangement, fluid pump 130 circulates the antifreeze solution 118 through the antifreeze accumulator tank 104 and the antifreeze coil 120. In some examples, the first port 178*a* of the antifreeze coil 120 may be arranged proximate to the top of the outdoor heat exchanger 112, while the second port 178*b* of the antifreeze coil 120 may be arranged proximate to the bottom of the outdoor heat exchanger 112.

In some examples, certain aspects of the heat pump system 100 of FIG. 2 may be provided as a modular retrofit kit to be installed with an existing heat pump system. In some examples, the modular retrofit kit may include aspects of the antifreeze circuit 106 and the outdoor heat exchanger 112. Accordingly, the modular retrofit kit may include the antifreeze accumulator tank 104 (with the controllable heater 122), the first refrigerant coil 110, the antifreeze solution 118 (preferably silicone oil), the antifreeze coil 120, the fluid pump 130, and one or more flexible and/or inflexible pipes or pathways to connect the aforementioned components. Further, the modular retrofit kit may include a retrofit controller configured to operate the aforementioned components (such as the controllable heater 122 and/or the fluid pump 130). The retrofit controller may be configured to integrate with an existing controller which operates the existing heat pump system, or it may be configured to operate independently. The integration may include electronic hardware and/or software aspects. Implementing the aforementioned modular retrofit kit with an existing heat pump system may be more significantly more cost effective than installing an entirely new heat pump system 100 as shown in FIG. 1 or 2.

Figure 3A:
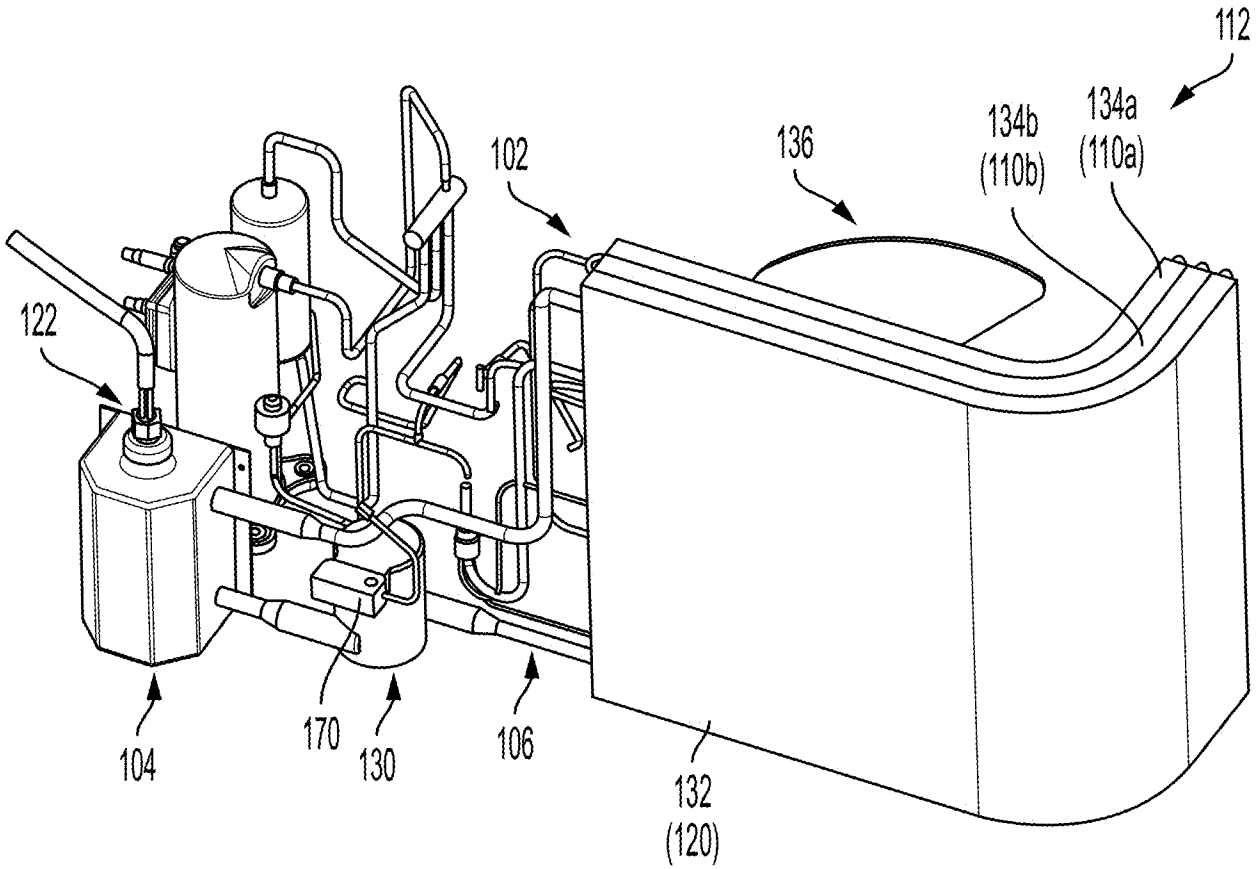
FIG. 3A is an isometric view of an antifreeze accumulator, a fluid pump, and an outdoor heat exchanger of a heat pump system, according to aspects of the present disclosure.
Figure 3B:
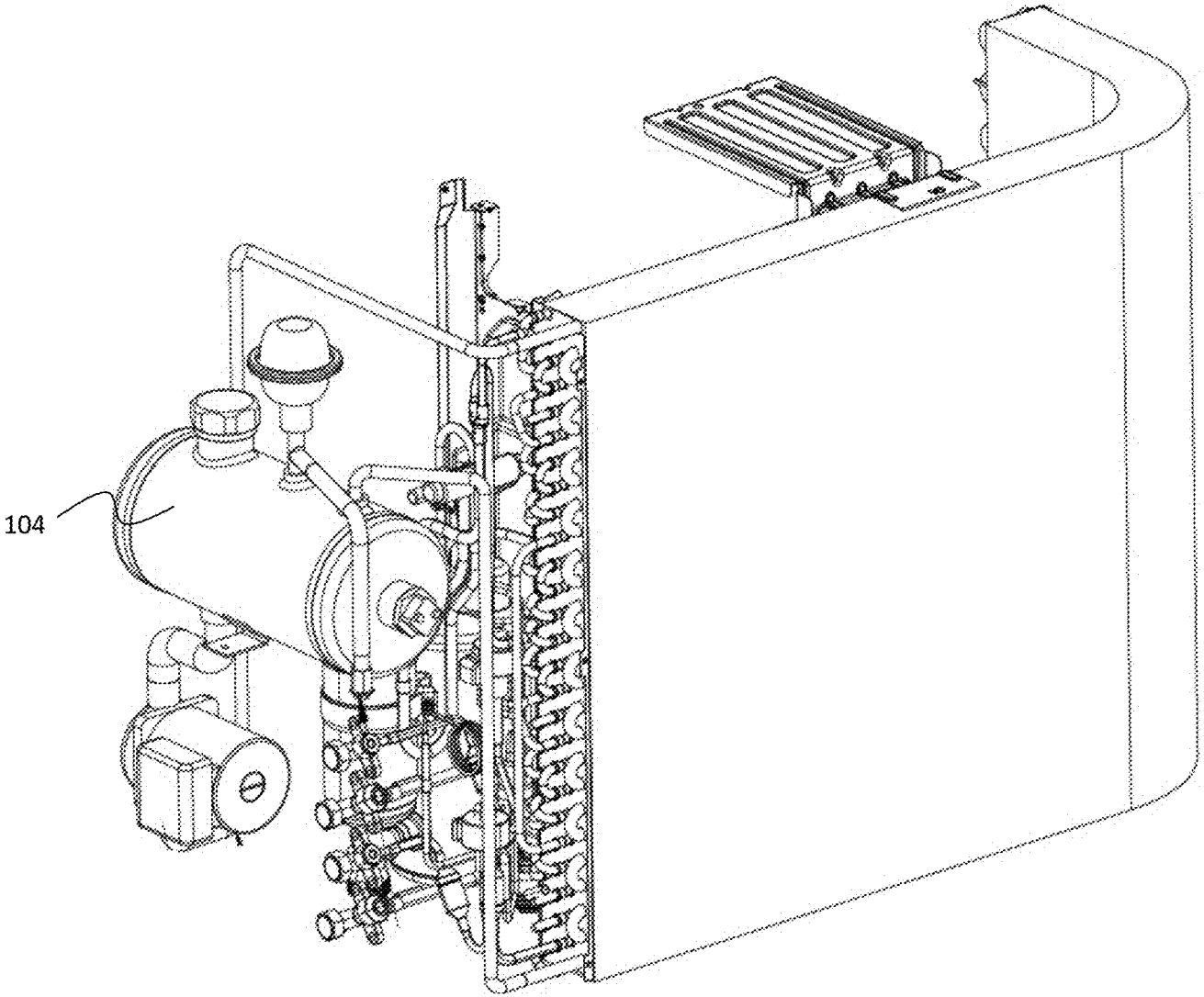
FIG. 3B is an isometric view of an antifreeze accumulator, a fluid pump, and an outdoor heat exchanger of a heat pump system, according to aspects of the present disclosure.
Figure 4:
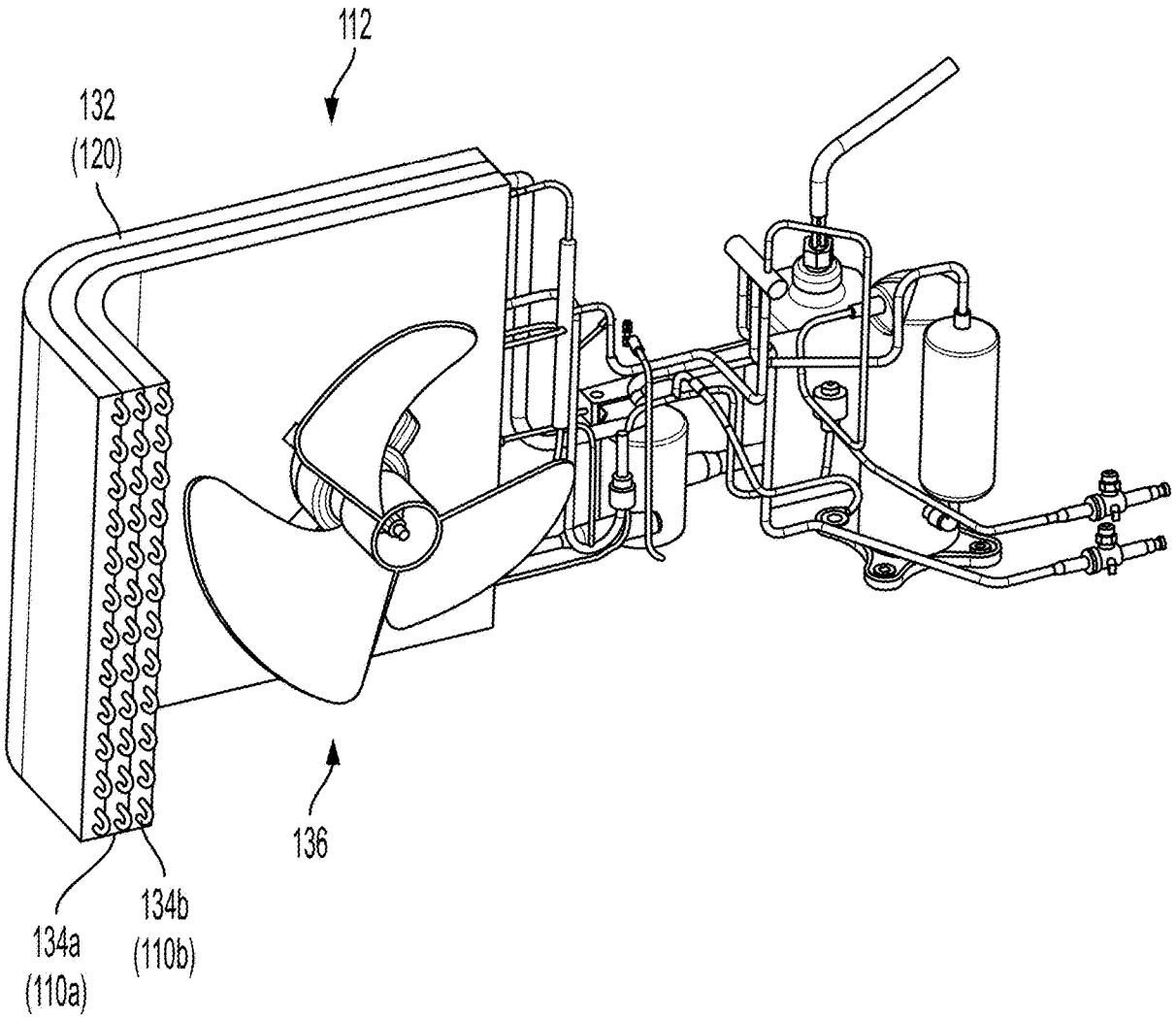
FIG. 4 is a further isometric view of an antifreeze accumulator, a fluid pump, and an outdoor heat exchanger of a heat pump system, according to aspects of the present disclosure.

FIGS. 3A, 3B, and 4 depict isometric views of aspects of the heat pump system 100. In particular, FIGS. 3A, 3B, and 4 show aspects of the refrigerant circuit 102 (such as one or more refrigerant pipes), aspects of the antifreeze circuit 106 (such as the antifreeze accumulator tank 104 the fluid pump 130, and one or more antifreeze pipes), and the outdoor heat exchanger 112. In one example, the components depicted in FIGS. 3A, 3B, and 4 would be arranged within a physical structure or enclosure such that only the outdoor heat exchanger 112 faces the outdoor environment. FIGS. 3A and 4 show the controllable heater 122 (in the form of an electrical rod) inserted into the antifreeze accumulator tank 104 to heat the antifreeze solution 118 collected by the antifreeze accumulator tank 104. Accordingly, the antifreeze solution 118 is heated to high temperature, high pressure, superheated vapor prior to entering the outdoor heat exchanger 112. The flow of the antifreeze solution 118 throughout the antifreeze circuit 106 is controlled by the fluid pump 130. As shown in FIG. 3A, the fluid pump 130 includes a pump controller 170. The pump controller 170 may communicate with the outdoor controller 101 (shown in FIGS. 1 and 2) to control the pump speed of the fluid pump 130. The pump controller 170 may control or modulate the pump speed based on measurements captured by one or more sensors arranged on or within the fluid pump 130, such as a temperature sensor and/or a pressure sensor. The pump speed may vary depending on various conditions. In some examples, the pump speed can be at least about 5.2 gallons per minute during normal operation. In other examples, such as in extremely cold outdoor temperatures, the pump speed may be increased to limit heat loss of the antifreeze solution 118 when circulating through the antifreeze coil 120. In further examples, the pump speed may be lowered during a maintenance cycle to, for example, flush out the antifreeze circuit 106. In some examples, the fluid pump 130 includes an impeller to propel the antifreeze solution 118 through the antifreeze circuit 106.

The outdoor heat exchanger 112 of FIGS. 3A, 3B, and 4 includes the outdoor fan 136 arranged to direct air through an external coil layer 132 and two internal coil layers 134*a*, 134*b*. The external coil layer 132 is in fluid communication with the antifreeze accumulator tank 104 and the fluid pump 130. Thus, the external coil layer 132 receives the antifreeze solution 118 via the antifreeze circuit 106. In the particular example of FIGS. 3A, 3B, and 4, the fluid pump 130 drives the antifreeze solution 118 into the external coil layer 132. After the antifreeze solution 118 circulates through the external coil layer 132, the antifreeze solution 118 exits the external coil layer 132 and flows to the antifreeze accumulator tank 104 for reheating. Accordingly, the external coil layer 132 may be considered the antifreeze coil 120. Further, the two internal coil layers 134*a*, 134*b* receive the refrigerant 108 via the refrigerant circuit 102. Each of the internal coils layers 134*a*, 134*b* may be considered a discrete outdoor refrigerant coil 110*a*, 110*b*. In this arrangement, the outdoor fan 136 forces air through the internal coil layers 134*a*, 134*b* and the external coil layer 132. This process converts the refrigerant 108 within the internal coil layers 134*a*, 134*b* to a low temperature, low pressure, slightly superheated vapor. The heated antifreeze solution 118 of the external coil layer 132 prevents frost from forming on the internal coil layers 134*a*, 134*b*, which, in turn, minimizes (or even eliminates) any need for a defrost cycle. The internal coil layers 134*a*, 134*b* may include a fin structure or a fin matrix to aid in the heat exchange between the air and the internal coil layers 134*a*, 134*b*. In some examples, the external coil layer 132 also includes a similar fin structure or fin matrix. In other examples, such as in warm outdoor ambient temperatures, ambient temperature antifreeze solution 118 may be circulated through the external coil layer 132 to prevent hot spots from forming on the internal coil layers 134*a*, 134*b*.

The accumulator tank 104 may be vertically oriented, as seen in FIG. 3A, or horizontally oriented, as seen in FIG. 3B. An advantage of a horizontally oriented accumulator tank 104 is that the heater 122 is almost always (or otherwise more easily) submerged within the antifreeze solution 118, providing stability to the heater 122. In a vertically oriented accumulator tank 104, there is a risk of the heater 122 (in the form of an electrical rod) disintegrating if the antifreeze solution 118 does not submerge the heater 122 completely. Both configurations are contemplated herein.

Figure 5:
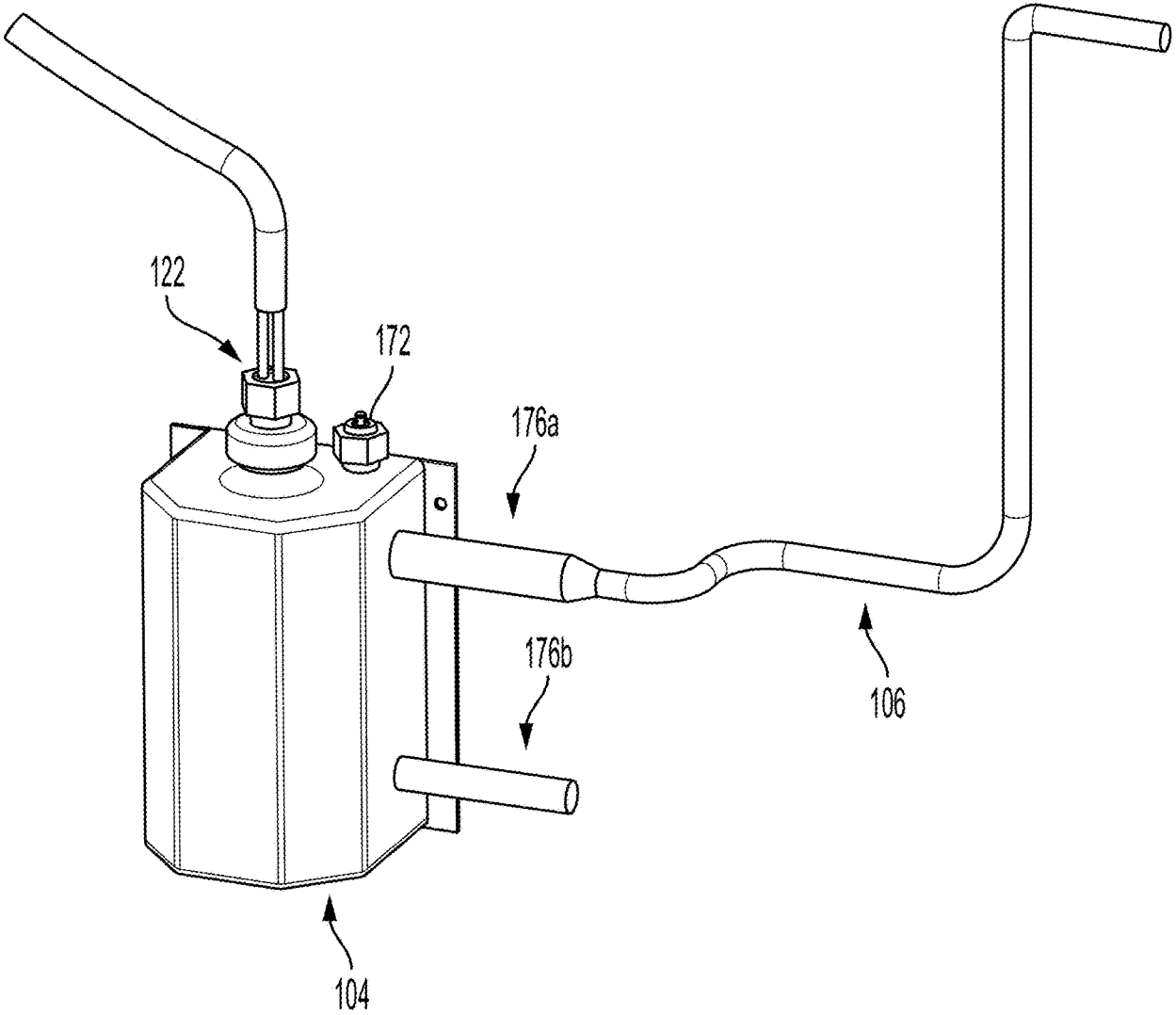
FIG. 5 is an isometric view of an antifreeze accumulator with a controllable heater, according to aspects of the present disclosure.

FIG. 5 is an isometric view showing the antifreeze accumulator tank 104 in greater detail. As shown in FIG. 5, the antifreeze solution 118 enters the antifreeze accumulator tank 104 from the antifreeze circuit 106 via an upper port 176*a*. Once inside the antifreeze accumulator tank 104, the antifreeze solution 118 is heated by the controllable heater 122. The heated antifreeze solution 118 then exits the antifreeze accumulator tank 104 via a lower port 176*b*. In the example of FIG. 6, the antifreeze accumulator tank 104 also includes a pressure release valve 172 to prevent damaging and/or dangerous amounts of pressure from building up within the antifreeze accumulator tank 104. In a preferred example, the antifreeze accumulator tank 104 is made of aluminum to prevent rust in outdoor conditions.

Figure 6D:
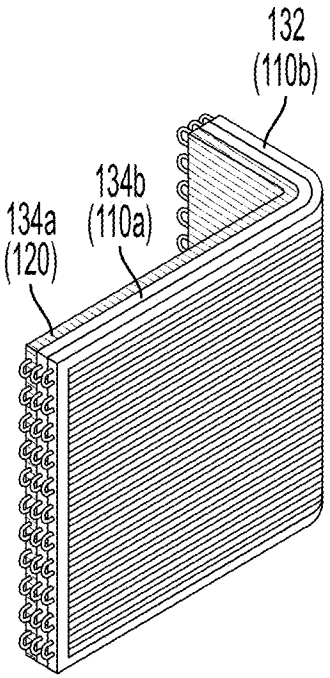
FIG. 6D is an isometric view of a variation of internal and external layers of an outdoor heat exchanger, according to aspects of the present disclosure.
Figure 6C:
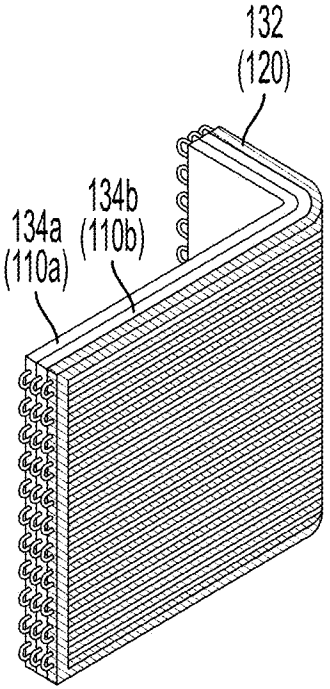
FIG. 6C is an isometric view of a variation of internal and external layers of an outdoor heat exchanger, according to aspects of the present disclosure.
Figure 6B:
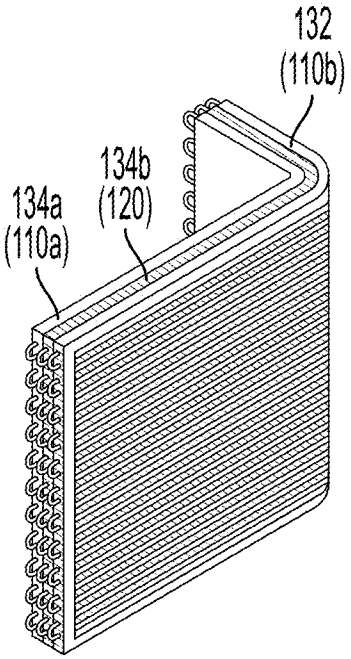
FIG. 6B is an isometric view of a variation of internal and external layers of an outdoor heat exchanger, according to aspects of the present disclosure.
Figure 6A:
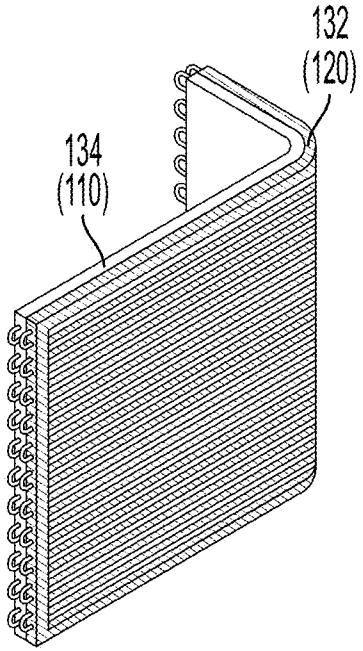
FIG. 6A is an isometric view of a variation of internal and external layers of an outdoor heat exchanger, according to aspects of the present disclosure.

FIGS. 6A-6D illustrate various arrangements of the one or more outdoor refrigerant coils 110*a*, 110*b* and the antifreeze coil 120 within the external coil layer 132 and the and the one or more internal coil layers 134 of the outdoor heat exchanger 112. In these examples, the external coil layer 132 faces the outdoor environment. In FIG. 6A, the refrigerant coil 110 is arranged within the internal coil layer 134, while the antifreeze coil 120 is arranged within the external coil layer 132. In FIG. 6B, a first refrigerant coil 110*a* is arranged within a first internal coil layer 134*a*, a second refrigerant coil 110*b* is arranged within the external coil layer 132, and the antifreeze coil 120 is arranged within a second internal coil layer 134*b*. The second internal coil layer 134*b* is arranged between the first internal coil layer 134*a* and the external coil layer 132. In FIG. 6C, the first refrigerant coil 110*a* is arranged within the first internal coil layer 134*a*, the second refrigerant coil 110*b* is arranged within the second internal coil layer 134*b*, and the antifreeze coil 120 is arranged within the external coil layer 132. In FIG. 6D, the first refrigerant coil 110*a* is arranged within the second internal coil layer 134*b*, the second refrigerant coil 110*b* is arranged within the external coil layer 132, and the antifreeze coil 120 is arranged within the first internal coil layer 134*a*.

Testing was performed to compare the performance of the heat pump system 100 shown in FIG. 2 in extreme cold conditions to a conventional heat pump system which did not include the antifreeze coil 120 in a dual coil configuration with the first refrigerant coil 110 in the outdoor heat exchanger 112. In other words, the conventional heat pump system was modified to include the mechanism and components related to the antifreeze circuit 106. In this testing scheme, the outdoor components illustrated in FIG. 2 were arranged in a simulated outdoor environment while the indoor components were arranged in a simulated indoor environment. Five (5) calibrated TESTO® sensors (pres sure, airflow, humidity, multiple temperature points) logged data every second. The heat pump systems were configured to heat the simulated indoor environment by pulling heat from the simulated outdoor environment in an attempt to maintain an indoor temperature of 75° F. The temperature within the outdoor environment steadily decreased from 57° F. to −24.2° F. to evaluate the performance of the heat pumps systems. Table 1 below shows the test data captured regarding the conventional heat pump system without the dual coil configuration.

TABLE 1

| Outdoor temp., physical simulation (° F.) | Antifreeze temp. at outdoor heat exchanger (° F.) | Temp. of air supplied at indoor heat exchanger (° F.) | Airflow at indoor heat exchanger (m/s) | Freezing? |
|---|---|---|---|---|
| 57 | N/A | N/A | 1 | No |
| 36 | N/A | 106 | 1 | No |
| 29 | N/A | 106 | 0.9 | No |
| 24 | N/A | 106 | 0.9 | No |
| 19 | N/A | 105 | 0.9 | No |
| 15 | N/A | 104.5 | 0.9 | No |
| 10 | N/A | 102 | 0.9 | No |
| 6 | N/A | 102 | 0.9 | No |
| 3 | N/A | 100 | 0.9 | No |
| 0 | N/A | 100 | 0.9 | No |
| −2 | N/A | 98 | 0.8 | No |
| −6 | N/A | 97 | 0.9 | Yes |
| −10 | N/A | 95.5 | 0.9 | Yes |
| −12 | N/A | 94. | 0.8 | Yes |
| −15.5 | N/A | 92.5 | 0.9 | Yes |
| −17 | N/A | 92.5 | 0.9 | Yes |
| −19 | N/A | 91 | 0.6 | Yes |
| −20 | N/A | 90 | 0.6 | Yes |
| −22 | N/A | 91 | 0.6 | Yes |
| −23.5 | N/A | 87 | 0.6 | Yes |
| −24.2 | N/A | 88 | 0.6 | Yes |

As shown in Table 1, frost begins to form on the outdoor heat exchanger 112 at an outdoor temperature between about −2° F. and about −6° F., triggering the system to enter defrost mode and reduce system efficiency. In this example, the indoor temperature begins to drop at an outdoor temperature of −10° F. At −15.5° F., the heat pump system is no longer able to produce comfortable indoor temperatures, and the indoor temperature falls below 57° F.

By contrast, the heat pump system 100 was installed in an environmental cold chamber capable of reaching below −55° F. Programmed defrost cycles were not enabled, and the system 100 was required to maintain heating operation for at least two (2) hours. Table 2 (shown below) provides analogous test data captured regarding the heat pump system 100 implementing the dual coil configuration as shown in FIG. 2, and Table 3 shows additional data of the heat pump system 100. In the example heat pump system 100 of FIG. 2, a first refrigerant coil 110*a* was arranged within the first internal coil layer 134*a* of the outdoor heat exchanger 112, the second refrigerant coil 110*b* was arranged within the second internal coil layer 134*b*, and the antifreeze coil 120 was arranged within the external coil layer 132 as shown in FIGS. 3, 4, and 6C.

TABLE 2

| Outdoor temp., physical simulation (° F.) | Antifreeze temp. at outdoor heat exchanger (° F.) | Temp. of air supplied at indoor heat exchanger (° F.) | Airflow at indoor heat exchanger (m/s) | Freezing? |
|---|---|---|---|---|
| 57 | 67 | 118 | 1 | No |
| 36 | 46 | 107 | 1 | No |
| 29 | 40 | 109 | 0.9 | No |
| 24 | 36 | 115 | 0.9 | No |
| 19 | 30 | 113 | 0.85 | No |
| 15 | 27 | 114 | 0.85 | No |
| 10 | 21.7 | 114 | 0.9 | No |
| 6 | 17.4 | 113 | 0.86 | No |
| 3 | 14.5 | 114 | 0.9 | No |
| 0 | 12 | 115 | 0.8 | No |
| −2 | 8.2 | 113 | 0.9 | No |
| −6 | 4.1 | 111 | 1 | No |
| −10 | 0.3 | 108 | 0.83 | No |
| −12 | −0.6 | 108 | 0.87 | No |
| −15.5 | −4.4 | 108 | 0.81 | No |
| −17 | −7 | 108 | 0.8 | No |
| −19 | −8.8 | 104.5 | 0.8 | No |
| −20 | −9.9 | 103.8 | 0.83 | No |
| −22 | −12.5 | 103 | 0.8 | No |
| −23.5 | −14 | 102.7 | 0.7 | No |
| −24.2 | −14.1 | 103 | 0.7 | No |

TABLE 2-continued

| Outdoor temp., physical simulation (° F.) | Antifreeze temp. at outdoor heat exchanger (° F.) | Temp. of air supplied at indoor heat exchanger (° F.) | Airflow at indoor heat exchanger (m/s) | Freezing? |
|---|---|---|---|---|
| −30 | Not measured | 100 | 0.7 | No |
| −33 | Not measured | 98 | 0.75 | No |
| −37 | Not measured | 95.5 | 0.77 | No |
| −40 | Not measured | 94.1 | 0.71 | No |
| −41 | Not measured | 91.5 | 0.7 | No |
| −42.1 | Not measured | 90.2 | 0.7 | No |
| −45.9 | Not measured | 88.5 | 0.7 | No |
| −49.8 | Not measured | 87.3 | 0.7 | No |
| −52.3 | Not measured | 86.4 | 0.7 | No |
| −52.4 | Not measured | 86.8 | 0.7 | No |
| −56.9 | Not measured | 85.9 | 0.7 | No |

TABLE 3

| Outdoor temp. (° F.) | Nominal heat output (BTU $h^{-1}$)* | Elec. input (kW)† | COP | Instantaneous HSPF (BTU $Wh^{-1}$)‡ |
|---|---|---|---|---|
| 32 | 33,500 | 4.03 | 2.44 | 8.32 |
| 22 | 33,500 | 4.37 | 2.25 | 7.67 |
| 12 | 33,500 | 4.71 | 2.09 | 7.12 |
| 2 | 33,500 | 5.05 | 1.95 | 6.64 |
| −8 | 33,500 | 5.39 | 1.82 | 6.22 |
| −18 | 33,500 | 5.73 | 1.71 | 5.85 |
| −28 | 33,500 | 6.07 | 1.62 | 5.52 |
| −38 | 33,500 | 6.41 | 1.53 | 5.22 |
| −56.9 | 33,500 | 7.03 | 1.40 | 4.77 |

As shown in Table 2, the dual coil configuration prevents frost formation on the outdoor heat exchanger 112 at outdoor temperatures as low as −56.9. This data contemplates frost prevention even at −30° F. Further, as evidenced by the measured temperatures provided by the indoor heat exchanger 116, the dual coil configuration also provides improved heating performance at all temperatures. Accordingly, the heat pump system 100 was able to maintain a comfortable indoor temperature of 75° F. at all tested ambient outdoor temperatures.

The data shown in Table 3 was captured from a heat pump system 100 having a 220 V compressor, a Si-05 heater rod, and a 100 V circulation/fluid pump. The 220 V compressor was operated at a current of 18 A and a power of 3.96 kW. The Si-05 heater rod generated between 0 and 3.00 kW of duty-cycled heat. The 100 V circulation/fluid pump was operated at a power of 0.065 kW. The duty cycle of the heater rod was modelled linearly: 0% at 32° F. ramping up to 100% at −56° F. to keep the antifreeze (e.g., silicone oil) approximately 15° F. warmer than the ambient environment. $HSPF_{instant‡}$ was determined by multiplying the coefficient of performance (COP) by 3.412 for direct BTU/Wh conversion. Seasonal HSPF will be higher than $HSPF_{instant}$ because the heater rod seldom runs at full duty in a real heating season. As noted, no defrost events were observed (i.e., no interruptions to heat delivery). Values of electrical input† accounted for all major electrical loads in the system 100, including the compressor 140, the heater 122, and the fluid/circulation pump 130.

Figure 7:
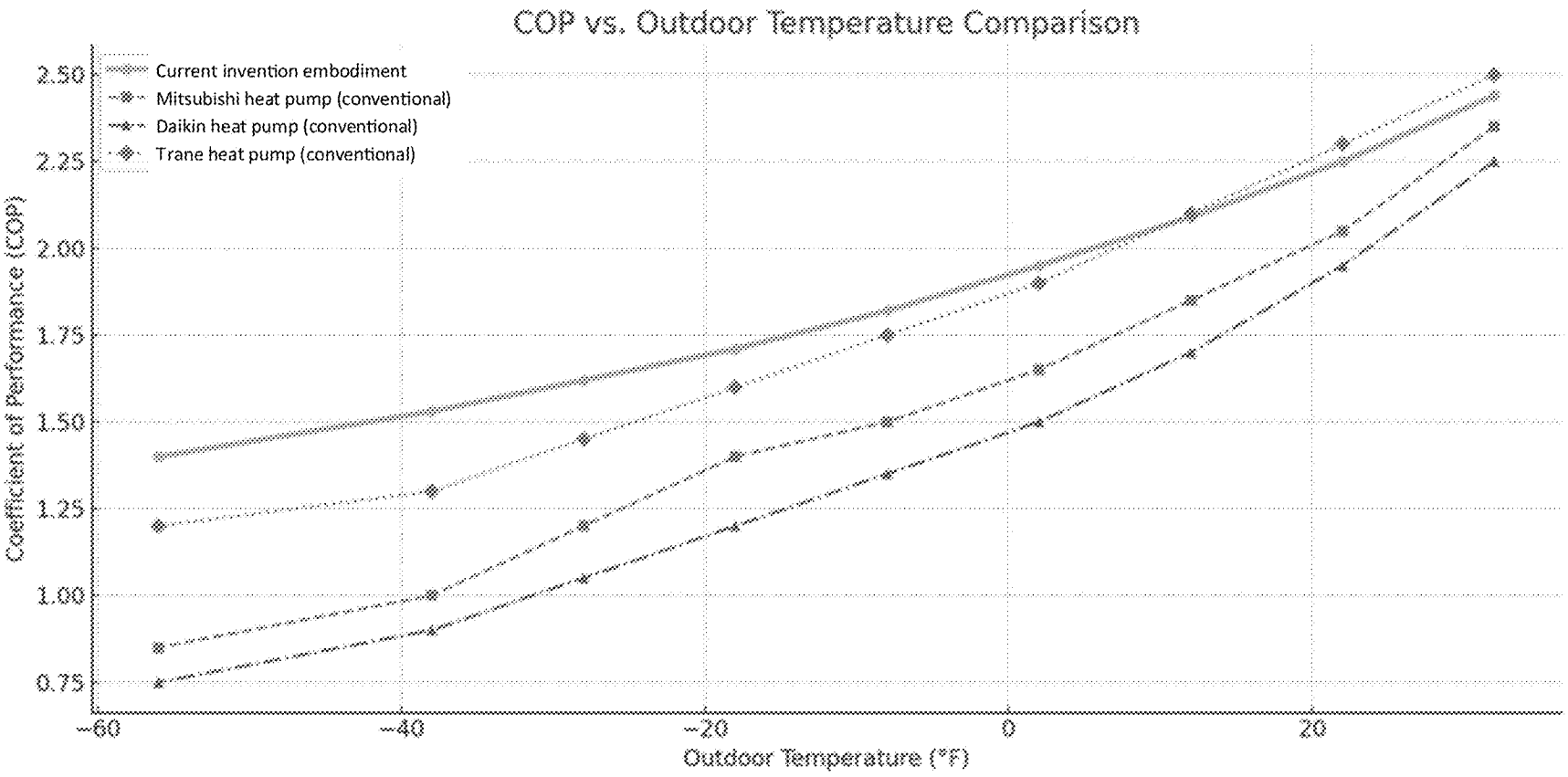
FIG. 7 is a plot comparing the coefficient of performance (COP) of the heat pump system of the present disclosure to conventional systems.
Figure 8:
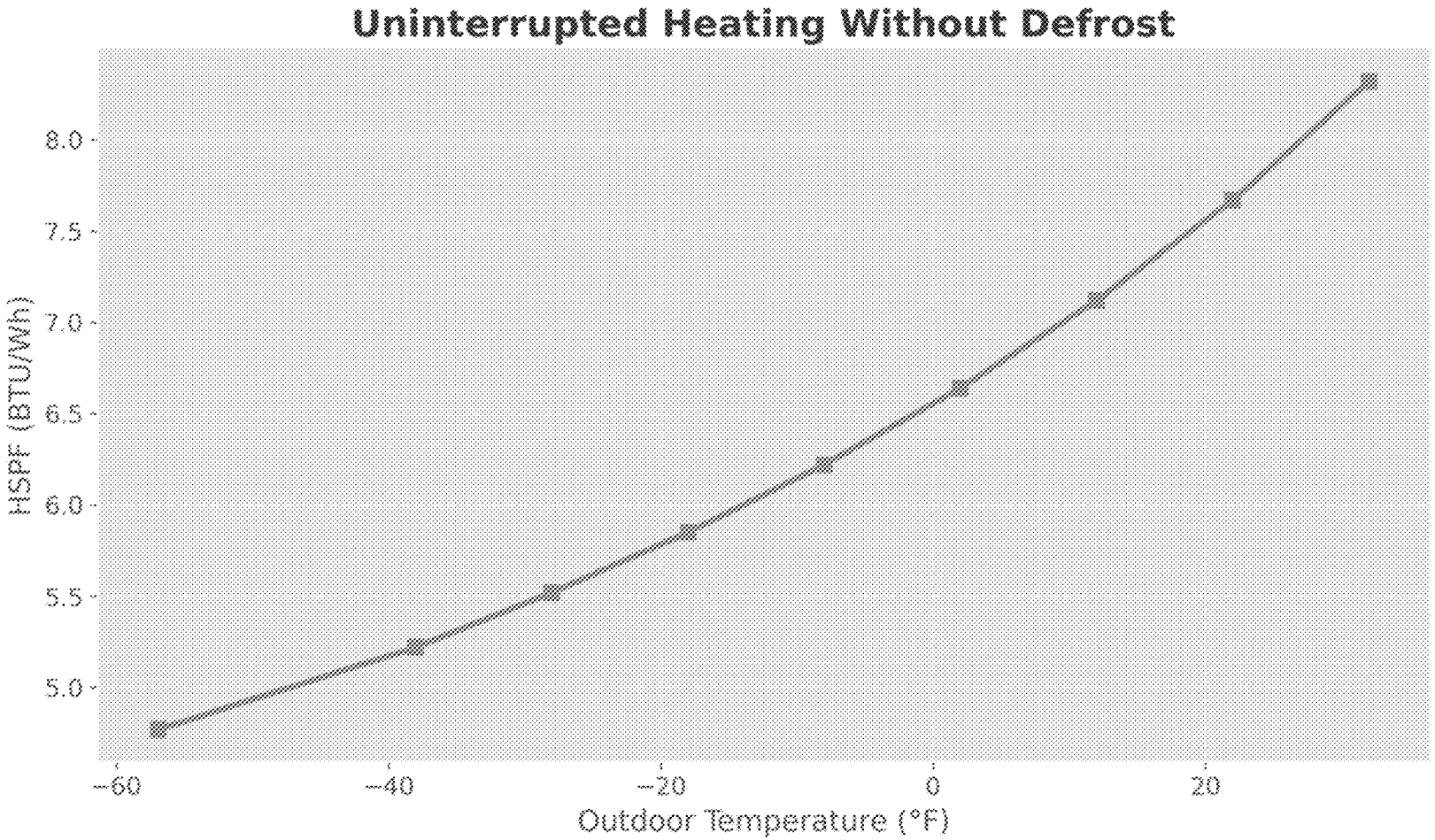
FIG. 8 is a plot showing example heating seasonal performance factor (HSPF) measurements of the heat pump system of the present disclosure.

Furthermore, it can be seen that nominal heat output* was held constant at the full rated capacity (33,500 BTU/h) across all temperatures in the test, whereas conventional systems will de-rate as temperatures decrease. It can also be seen that the heat pump system 100 achieved favorable COP in extreme conditions (see FIG. 7 for a comparison to conventional systems) and uninterrupted operation down to at least −56.9° F. (see FIG. 8 for HSPF measurements), a temperature at which conventional heat pump systems will typically lock out or initiate a defrost cycle every 30-40 minutes. In contrast, the heat pump system 100 maintained stable and refrigerant pressures as the cold chamber continued reducing temperature. At −56.9° F., the temperature of the air delivered at the indoor heat exchanger 116 was found to be 85.9° F. and as such within residential comfort range, without auxiliary electric resistance backup. Furthermore, zero defrost cycles were observed. A flat, continuous supply-air curve was seen, with no temperature dips, refrigerant lock-ups, or compressor stalls that would signal a defrost event. It is noted that conventional heat pump systems, at ambient temperatures below about −20° F., the refrigerant becomes dense, and/or the pressure decreases, causing the compressor to stall to protect itself.

With further reference to the heat pump system of FIG. 2, certain advantages provided by using the antifreeze coil 120 to cool the first refrigerant coil 110 are illustrated as follows. First, the efficiency of the compressor 140 is improved. In conventional cooling modes, the compressor 140 works harder when the first refrigerant coil 110 overheats, increasing power draw and mechanical stress. By maintaining a consistent temperature of the first refrigerant coil 110 through ambient temperature silicone oil circulation, the compressor 140 operates within optimal thermal limits, thereby reducing thermal cycling and prolonging the life of the compressor 140.

Second, the performance of the first refrigerant coil 110 is improved. During cooling, the first refrigerant coil 110 must effectively release heat absorbed from indoor spaces. Overheating reduces the temperature gradient between the first refrigerant coil 110 and outdoor air, diminishing cooling capacity. Circulating ambient temperature silicone oil continuously extracts excess heat from the first refrigerant coil 110, maintaining a stable temperature conducive to efficient heat rejection. Stabilizing the temperature of the first refrigerant coil 110 enhances the heat dissipation rate by up to 25%, ensuring that the refrigerant condenses effectively, even under high thermal loads.

Third, the stability of the refrigerant cycle is improved. Fluctuating temperatures of the first refrigerant coil 110 cause inconsistent refrigerant condensation, leading to pressure imbalances and suboptimal cooling. The thermal stabilization provided by the silicone oil ensures that the temperature of the first refrigerant coil 110 remains within the ideal condensation range, maintaining a consistent phase change. Keeping the temperature of the first refrigerant coil 110 within the ideal condensation range reduces the likelihood of liquid slugging or compressor stress, maintaining refrigerant efficiency.

Fourth, the efficiency of the expansion valve 152 is improved. Inconsistent cooling at the first refrigerant coil 110 can result in improper refrigerant metering by the expansion valve 152. Stabilizing the temperature if the first refrigerant coil 110 allows the expansion valve to maintain accurate refrigerant flow, optimizing cooling efficiency, reducing valve wear, and preventing overfeeding or underfeeding of refrigerant 108.

Fifth, the efficiency of the outdoor fan 136 and other airflow dynamics are improved. Excessively hot surfaces on the first refrigerant coil 110 can create localized heat pockets, reducing airflow efficiency and heat transfer rates. The continuous circulation of ambient temperature oil lowers the surface temperature, promoting efficient air movement across the first refrigerant coil 110. This continuous circulation improves convective heat transfer and reduces power requirements of the outdoor fan 136, leading to quieter and more efficient operation.

The efficiency of the improved cooling aspect of the heat pump system 100 may be demonstrated in terms of seasonal energy efficiency ratio (SEER). SEER measures the energy efficiency of an air conditioning or heat pump system during a typical cooling season. SEER s determined by diving cooling output (in BTUs) by total energy input (in watt-hours). The cooling output is the total amount of heat removed from the air during the cooling season, and the total energy input is the total electrical energy consumed by the system during that period. For example, if a cooling system removes 36,000 BTUs over a season and consumes 2,000 Watt-Hours, the SEER would be 18, meaning that the system produces 18 BTUs per watt-hour of electricity consumed.

SEER is an important metric for a number of reasons. First, higher SEER values indicate a more energy-efficient system. Second, a higher SEER means lower electricity bills because the unit uses less power for the same cooling output. Third, efficient systems improve environmental impact by reducing carbon footprint. Four, SEER can be used to compare the efficiency of different AC units.

Typical SEER ratings are provided in Table 4 below.

TABLE 4

| Efficiency Level | SEER Value Range | Example Usage |
|---|---|---|
| Low Efficiency (Older) | 10-13 | Older AC units or basic cooling systems |
| Medium Efficiency | 14-16 | Standard residential air conditioners |
| High Efficiency | 17-20 | Modern energy-efficient cooling systems |
| Ultra-High Efficiency | 21+ | Premium HVAC systems and heat pumps |

As of 2023, minimum SEER for central air conditioners in the United States is 14. Canada generally follows the US standards but varies slightly by province. The EU uses Seasonal Coefficient of Performance (SCOP), which is similar but accounts for both heating and cooling.

In addition to SEER, energy efficiency ratio (EER) is also used to quantify efficiency. While SEER measures efficiency over a season, accounting for varying temperatures, EER measures efficiency at a specific outdoor temperature (usually 95° F. or 35° C.). SEER is generally preferred for providing a real-world estimate, since it averages the system's performance over a cooling season, considering fluctuating conditions.

Various conditions can cause SEER to vary. Higher outdoor ambient temperatures can lower SEER. Dirty coils or clogged filters reduce efficiency. Additionally, advanced systems with variable speed compressors and smart controls typically achieve higher SEER values.

As previously indicated, the SEER of units implementing the aforementioned cooling mode are determined to have an estimated SEER of 17.56. Upgrading from a standard low efficiency 13 SEER unit to a 17 SEER unit can result in approximately 764 kWh saved per year with an annual cooling load of 3,000 kWh. If power costs 13 cents per kWh, $99.32 USD is saved per year.

In sum, SEER measures seasonal energy efficiency of cooling systems. Higher SEER means lower energy consumption and reduced costs. It is a key factor when choosing a new air conditioner or heat pump, especially for areas with long cooling seasons.

Table 5 illustrates improvement in SEER by replacing or modifying conventional systems with the heat pump system illustrated in FIG. 2 for both heating and cooling.

TABLE 5

| Unit Size | Efficiency Standard | Typical SEER | Estimated SEER with Embodiments of Current Invention | SEER Gain | Percentage Increase (%) |
|---|---|---|---|---|---|
| 1 Ton | Standard Low Efficiency | 13 | 17.56 | +4.56 | +35.09% |
| 1 Ton | Standard Medium Efficiency | 15 | 17.56 | +2.56 | +17.08% |
| 1 Ton | Standard High Efficiency | 18 | 17.56 | −0.44 | −2.43% |
| 1.5 Ton | Standard Low Efficiency | 13 | 17.56 | +4.56 | +35.09% |
| 1.5 Ton | Standard Medium Efficiency | 15 | 17.56 | +2.56 | +17.08% |
| 1.5 Ton | Standard High Efficiency | 18 | 17.56 | −0.44 | −2.43% |
| 2 Ton | Standard Low Efficiency | 13 | 17.56 | +4.56 | +35.09% |
| 2 Ton | Standard Medium Efficiency | 15 | 17.56 | +2.56 | +17.08% |
| 2 Ton | Standard High Efficiency | 18 | 17.56 | −0.44 | −2.43% |
| 3 Ton | Standard Low Efficiency | 13 | 17.56 | +4.56 | +35.09% |
| 3 Ton | Standard Medium Efficiency | 15 | 17.56 | +2.56 | +17.08% |
| 3 Ton | Standard High Efficiency | 18 | 17.56 | −0.44 | −2.43% |
| 4 Ton | Standard Low Efficiency | 13 | 17.56 | +4.56 | +35.09% |
| 4 Ton | Standard Medium Efficiency | 15 | 17.56 | +2.56 | +17.08% |
| 4 Ton | Standard High Efficiency | 18 | 17.56 | −0.44 | −2.43% |
| 5 Ton | Standard Low Efficiency | 13 | 17.56 | +4.56 | +35.09% |
| 5 Ton | Standard Medium Efficiency | 15 | 17.56 | +2.56 | +17.08% |
| 5 Ton | Standard High Efficiency | 18 | 17.56 | −0.44 | −2.43% |

The heat pump system 100 may include software (1) to regulate and optimize energy consumption in order to increase COP and/or heating seasonal performance factor (HSPF) and/or (2) to include flow direction logic based on ambient sensor feedback in order to switch between heating and cooling modes described herein. In such a system 100, the fluid pump 130 can optionally be a variable speed pump that is regulated by such software.

All definitions, as defined and used herein, should be understood to control over dictionary definitions, definitions in documents incorporated by reference, and/or ordinary meanings of the defined terms.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one" or "one or more" in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements can optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

As used herein, "about" or "approximately" means approximately or nearly, and in the context of a numerical value or range set forth means ±15% of the numerical. In exemplary embodiments, the term "about" can include traditional rounding according to significant figures of the numerical value. In addition, the phrase "about 'x' to 'y'" includes "about 'x' to about 'y'".

Further, any range of numbers recited in the specification or claims, such as that representing a particular set of properties, units of measure, conditions, physical states or percentages, is intended to literally incorporate expressly herein by reference or otherwise, any number falling within such range, including any subset of numbers within any range so recited. For example, whenever a numerical range with a lower limit, RL, and an upper limit RU, is disclosed, any number R falling within the range is specifically disclosed. In particular, the following numbers R within the range are specifically disclosed: R=RL+k (RU-RL), where k is a variable ranging from 1% to 100% with a 1% increment, e.g., k is 1%, 2%, 3%, 4%, 5% . . . 50%, 51%, 52% . . . 95%, 96%, 97%, 98%, 99%, or 100%. Moreover, any numerical range represented by any two values of R, as calculated above, is also specifically disclosed.

Other implementations are within the scope of the following claims and other claims to which the applicant can be entitled.

While various examples have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the examples described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize or be able to ascertain using no more than routine experimentation, many equivalents to the specific examples described herein. It is, therefore, to be understood that the foregoing examples are presented by way of example only and that, within the scope of the appended claims and equivalents thereto, examples can be practiced otherwise than as specifically described and claimed. Examples of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

What is claimed is:

1. A heat pump system, comprising:

a refrigerant circuit through which a refrigerant is caused to flow, wherein the refrigerant circuit comprises:

a first refrigerant coil arranged within a first heat exchanger; and a second refrigerant coil arranged within a second heat exchanger;

an antifreeze circuit through which an antifreeze solution is caused to flow, comprising:

an antifreeze accumulator tank configured to heat the antifreeze solution; and an antifreeze coil arranged within the first heat exchanger and proximate to the first refrigerant coil such that the antifreeze coil regulates a temperature of the first refrigerant coil, wherein the first heat exchanger comprises an external coil layer and at least one internal coil layer, wherein the antifreeze coil is arranged within the external coil layer, and wherein the first refrigerant coil is arranged within the at least one internal coil layer, wherein the first refrigerant coil and the antifreeze coil are eccentric to each other, whereby the heat pump system is configured to operate continuously without entering a defrost cycle, without compressor stall, and/or without refrigerant lock-up at an outdoor ambient temperature below about −5° F.

2. The heat pump system of claim 1, wherein the antifreeze accumulator tank comprises a controllable heater arranged to heat the antifreeze solution.

3. The heat pump system of claim 2, wherein the antifreeze accumulator tank further comprises a temperature sensor configured to generate a temperature signal, and wherein a temperature of the controllable heater is controlled based on the temperature signal.

4. The heat pump system of claim 3, wherein the temperature of the controllable heater ranges from 180° F. to 200° F.

5. The heat pump system of claim 2, further comprising an ambient temperature sensor configured to capture the outdoor ambient temperature, wherein the controllable heater is deactivated if the outdoor ambient temperature is greater than about 68° F.

6. The heat pump system of claim 1, wherein the refrigerant circuit further comprises a third refrigerant coil arranged within the antifreeze accumulator tank such that the third refrigerant coil heats the antifreeze solution.

7. The heat pump system of claim 1, wherein a freezing point of the antifreeze solution is less than or equal to about −30° F.

8. The heat pump system of claim 1, wherein a boiling point of the antifreeze solution is greater than or equal to about 200° F.

9. The heat pump system of claim 1, wherein the antifreeze solution comprises silicone oil.

10. The heat pump system of claim 1, wherein the heat pump system is configured to operate continuously without entering a defrost cycle, without compressor stall, and/or without refrigerant lock-up at the outdoor ambient temperature as low as about −56.9° F.

11. The heat pump system of claim 1, wherein the heat pump system comprises a cooling mode, in which the antifreeze coil is configured to be a heat sink that prevents hot spot formation on the first refrigerant coil up to an ambient temperature of about 86° F.

12. The heat pump system of claim 1, wherein the first heat exchanger is configured to be arranged in an outdoor environment, and the second heat exchanger is configured to be arranged in an indoor environment.

13. The heat pump system of claim 1, further comprising an antifreeze fluid pump configured to propel the antifreeze solution through the antifreeze circuit, wherein the antifreeze fluid pump has a pump speed of at least about 5.2 gallons per minute.

14. The heat pump system of claim 13, further comprising:

a controllable heater arranged to heat the antifreeze solution; and a controller configured to receive an ambient temperature and the temperature of the first refrigerant coil and to modulate the controllable heater and the antifreeze fluid pump.

15. A heat exchanger configured to be installed in a heat pump system, the heat exchanger comprising:

a refrigerant circuit through which a refrigerant is caused to flow, wherein the refrigerant circuit comprises a refrigerant coil;

an antifreeze circuit through which an antifreeze solution is caused to flow, wherein the antifreeze circuit comprises:

an antifreeze accumulator tank configured to heat the antifreeze solution, and an antifreeze coil arranged proximate to the refrigerant coil such that the antifreeze coil regulates a temperature of the refrigerant coil, an internal coil layer within which the refrigerant coil is arranged; and an external coil layer within which the antifreeze coil is arranged, wherein the refrigerant coil and the antifreeze coil are eccentric to each other.

16. A heat pump system, comprising:

a refrigerant circuit through which a refrigerant is caused to flow, wherein the refrigerant circuit comprises a refrigerant coil arranged within an outdoor heat exchanger; and an antifreeze circuit through which an antifreeze solution is caused to flow, wherein the antifreeze circuit includes an antifreeze coil arranged within the outdoor heat exchanger and proximate to the refrigerant coil to (i) prevent frost formation on the refrigerant coil in ambient outdoor temperatures lower than about −5° F. and (ii) prevent hot spot formation in ambient outdoor temperatures from about 68° F. to about 86° F., wherein the outdoor heat exchanger comprises an external coil layer and an internal coil layer, the antifreeze coil is arranged within the external coil layer, and the refrigerant coil is arranged within the internal coil layer, wherein the refrigerant coil and the antifreeze coil are eccentric to each other.

17. The heat pump system of claim 16, wherein a freezing point of the antifreeze solution is less than or equal to about −30° F.

18. The heat pump system of claim 16, wherein a boiling point of the antifreeze solution is greater than or equal to about 200° F.

19. The heat pump system of claim 16, wherein a boiling point of the refrigerant is less than or equal to −50° F.

* * * * *